US006286977B1

(12) United States Patent
Tseng

(10) Patent No.: US 6,286,977 B1
(45) Date of Patent: Sep. 11, 2001

(54) DECORATIVE LIGHT WITH A LOCK DEVICE

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/547,429

(22) Filed: Apr. 12, 2000

(51) Int. Cl.[7] ..... H01R 33/00
(52) U.S. Cl. ..... 362/226; 362/249; 362/806
(58) Field of Search ..... 362/226, 249, 362/252, 382, 396, 806, 441, 446, 448, 389; 439/357, 358

(56) References Cited

U.S. PATENT DOCUMENTS 4,318,158 * 3/1982 Livermore et al. ..... 362/226
5,669,703 * 9/1997 Wheeler et al. ..... 362/249
5,988,830 * 11/1999 Huang ..... 362/249

* cited by examiner

*Primary Examiner*—Y. Quach
(74) *Attorney, Agent, or Firm*—Jackson Walker L.L.P.

(57) ABSTRACT

A decorative light with a lock device has a socket, a base inserted into the socket and a bulb mounted in the base. A locking tab is integrally formed on the base and a protrusion is integrally formed on the free end of the locking tab. A retaining structure to engage the protrusion of the locking tab is disposed on the inner periphery of the socket. Consequently, the base can be securely held in the socket by the engagement between the retaining feature and the protrusion, and the base will not inadvertently detach from the socket even when an external force is applied.

4 Claims, 5 Drawing Sheets

DECORATIVE LIGHT WITH A LOCK DEVICE

BACKGROUND OF THE INVENTION

1. Field of the Invention

The present invention relates to a decorative light, and more particularly to a decorative light with a lock device.

2. Description of Related Art

With reference to FIG. 7, a conventional decorative light in accordance with the prior art comprises a socket (50), a base (52) inserted into the socket (50) and a bulb (54) mounted on the base (52). Two electric wires (not shown) are inserted into the bottom of the socket (50) and electrically connect to the two electrodes (not numbered) of the bulb (54) to provide electricity to the bulb (54). In addition, a protrusion (522) is integrally formed on the outside surface of the base (52). A recess (502) is defined in one end of the socket (50) to securely clamp the protrusion (522), such that the base (52) can be securely held in the socket (50) by the engagement between the recess (502) and the protrusion (522).

However, the engagement between the recess (502) and the protrusion (522) is not adequate to overcome a large external force or a pull. Therefore with reference to FIG. 8, another embodiment of the conventional decorative light has a block (602) integrally formed on the outer edge of the socket (60) with a recess (604) defined on the free edge of the block (602). A locking tab (622) extends laterally from the outer periphery of the base (62), and an expanded end (624) with a dimension larger than that of the locking tab (622) is formed on the free end of the locking tab (622).

When the base (62) is inserted into the socket (60), the locking tab (622) is bent corresponding to the socket (60) and received in the recess (604) of the block (602). The base (62) can be securely mounted in the socket (60) due to the engagement between the expanded end (624) of the locking tab (622) and the recess (604) of the block (602).

However, because the conventional decorative light lock device is on the outside, the base (62) can still be dislodged from the socket (60) by a force applied in an appropriate direction or a pulling force.

An LED is used as the bulb (54, 64) in many conventional decorative lights to reduce the power consumption. However, when the base (52, 62) comes loose from the socket (50,60) and is reinserted into the socket (50,60), the electrical connection between the LED and the electrical power may be incorrect. In that case, the LED or even all of the LEDs in the set will burn out due to the incorrect connection of the electrodes.

To overcome the shortcomings, the present invention tends to provide an improved decorative light to mitigate or obviate the aforementioned problems.

SUMMARY OF THE INVENTION

The main objective of the invention is to provide an improved decorative light having a socket, a base, a bulb and a locking tab that cannot easily be accidentally dislodged. The locking tab integrally formed on the base with a nub integrally formed on the free end of the locking tab is firmly held on the inner periphery of the socket. Consequently, the locking tab is not exposed or susceptible to being opened by an inadvertent force.

Other objects, advantages and novel features of the invention will become more apparent from the following detailed description when taken in conjunction with the accompanying drawings.

DETAILED DESCRIPTION OF PREFERRED EMBODIMENT

Figure 1:
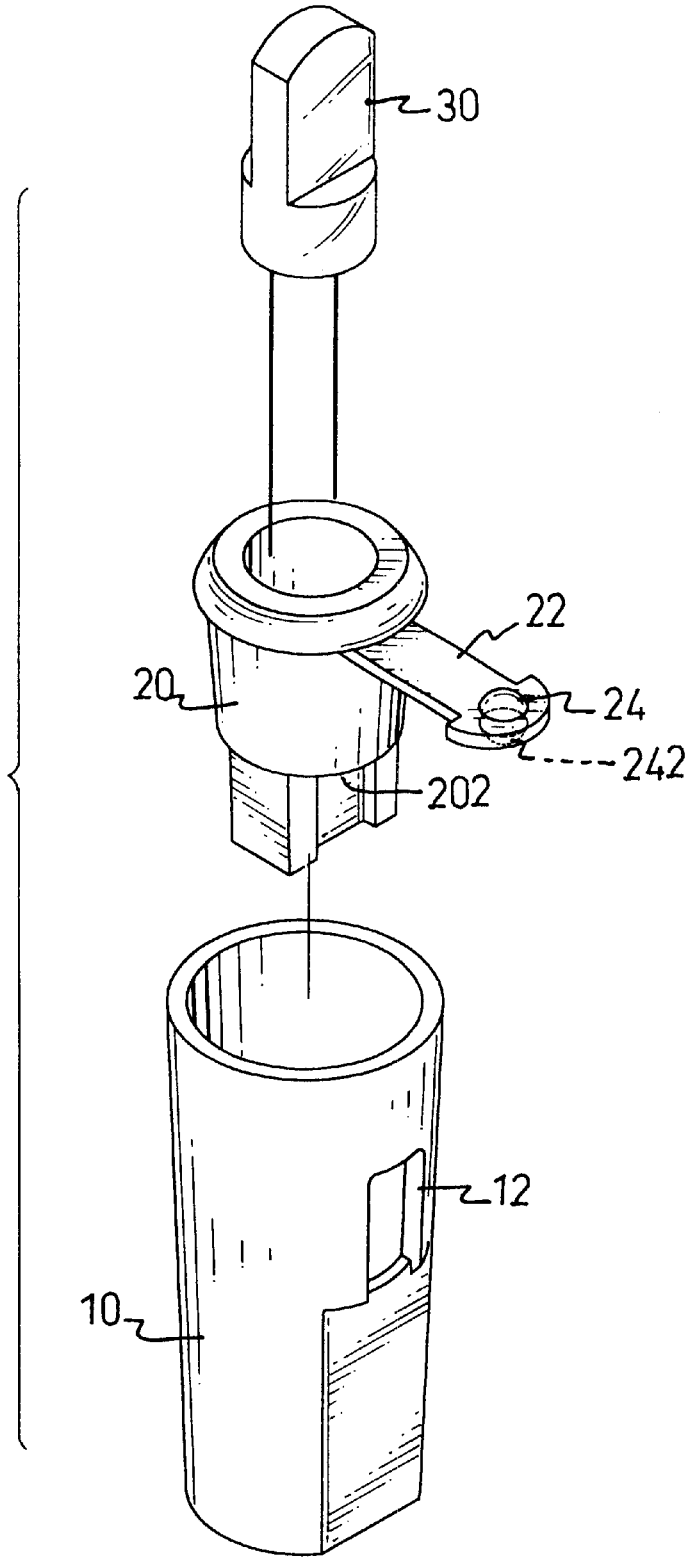
FIG. 1 is an exploded perspective view of a decorative light with a lock device in accordance with the present invention.
Figure 2:
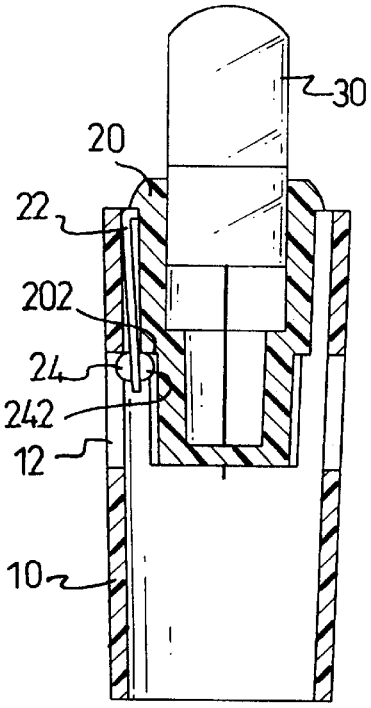
FIG. 2 is a side plan view in partial section of the decorative light in FIG. 1.

Referring to FIGS. 1 and 2, a decorative light with a lock device in accordance with the present invention comprises a socket (10), a base (20) inserted into the open end of the socket (10) and a bulb (30) mounted on the base (20). Two electric wires (not shown) are inserted into the bottom of the socket (10) and electrically connect to the two electrodes of the bulb (30) to provide electricity to the bulb (30).

A locking tab (22) extends laterally from the base (20). When the base (20) is inserted into the socket (10), the locking tab (22) will be bent and inserted into the socket (10) simultaneously. A protrusion is integrally formed on both sides of the free end of the locking tab (22). A retaining structure to engage with the protrusion is disposed on the inner surface of the socket (10). The protrusion is a nub (24) integrally formed on the side of the locking tab (22) facing the inner periphery of the socket (10). The retaining structure is a hole (12) defined in the side of the socket (10). When the base (20) is inserted into the socket (10), the nub (24) formed on the locking tab (22) will engage edge of the hole (12) defined in the socket (10). Thus, an internal locking device for securely mounting the base (20) on the socket (10) is provided. The base (20) will not inadvertently detach from the socket (10) even if an external force is applied or anybody pulls the base (20).

Figure 4:
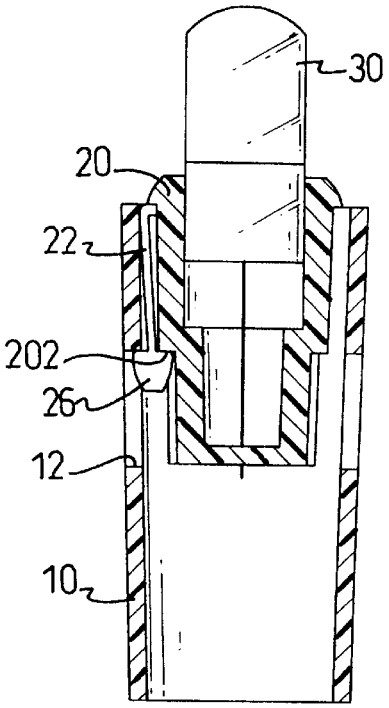
FIG. 4 is a side plan view in partial section of the decorative light in FIG. 3.
Figure 3:
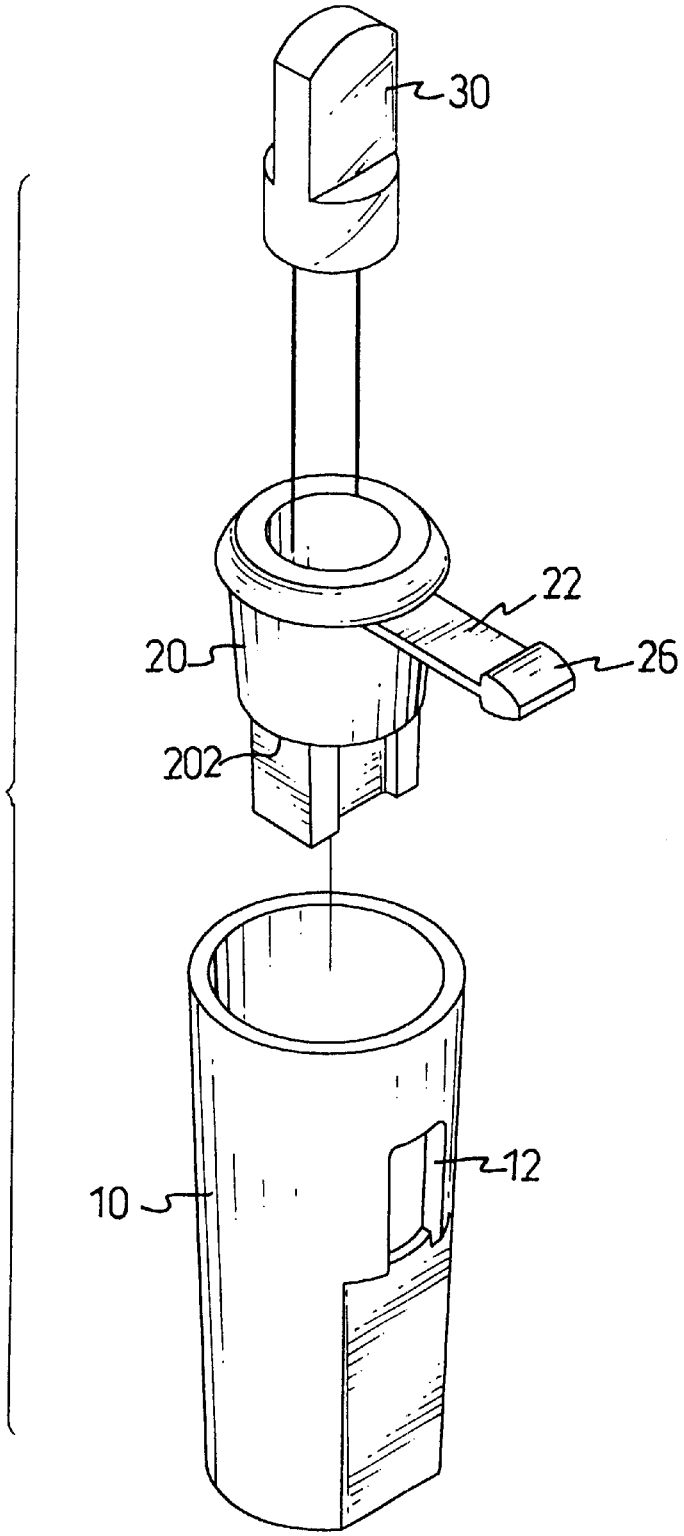
FIG. 3 is an exploded perspective view of an another embodiment of the decorative light with a lock device in accordance with the present invention.
Figure 7:
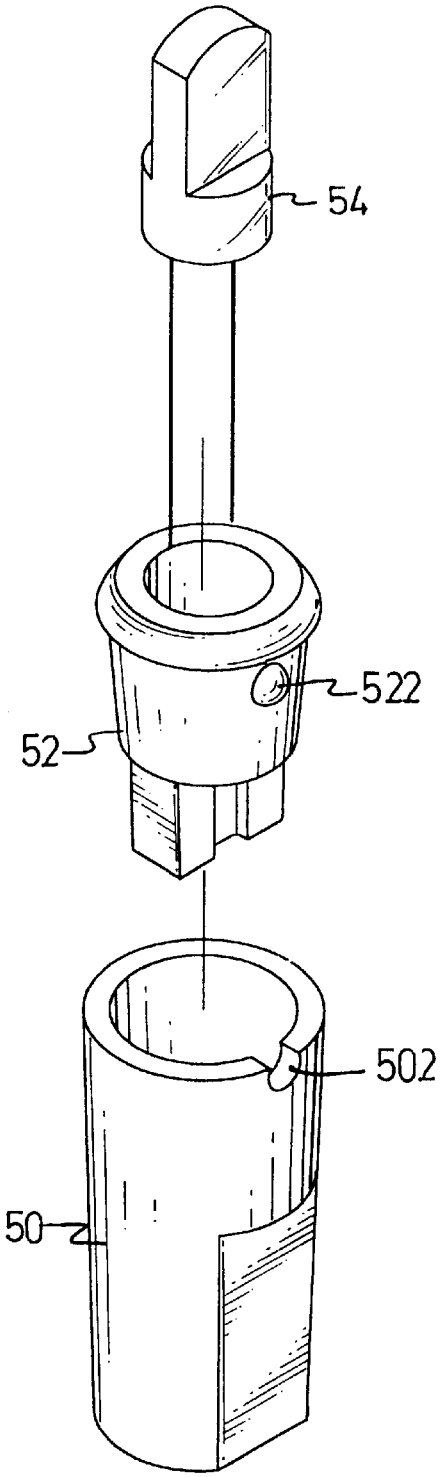
FIG. 7 PRIOR ART
FIG. 7 is an exploded perspective view of a conventional decorative light with a lock device in accordance with the prior art.
Figure 8:
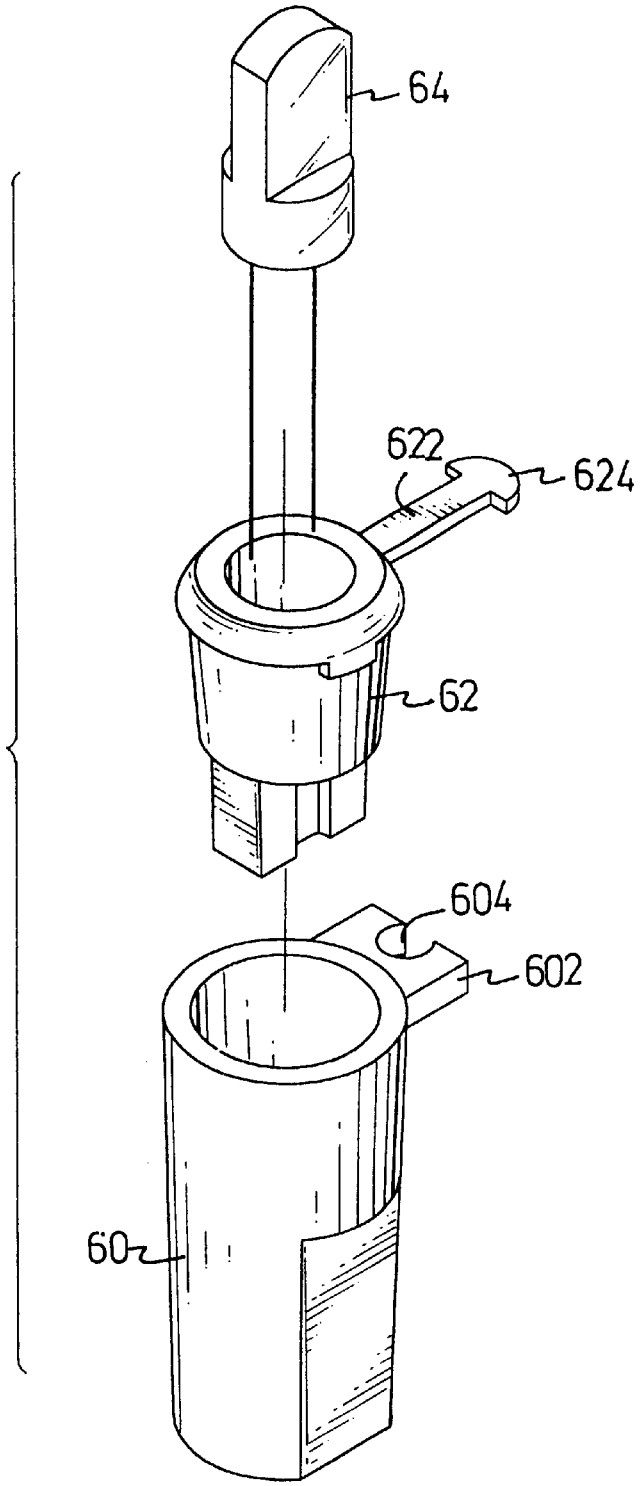
FIG. 8 PRIOR ART
FIG. 8 is an exploded perspective view of an another conventional decorative light with a lock device in accordance with the prior art.

With reference to FIGS. 3 and 4, the protrusion is a lug (26) integrally extending outward from the free end of the locking tab (22), such that the base (20) can be securely held in the socket (10) by the engagement between the lug (26) and the hole (12).

Figure 6:
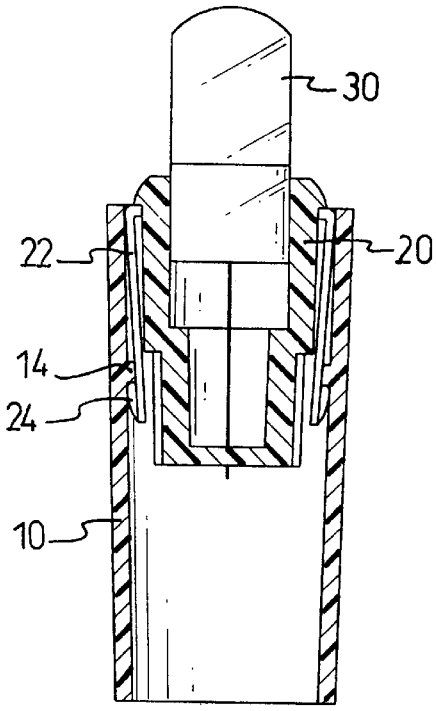
FIG. 6 is a side plan view in partial section of a fourth embodiment of the decorative light with a lock device in accordance with the present invention.
Figure 5:
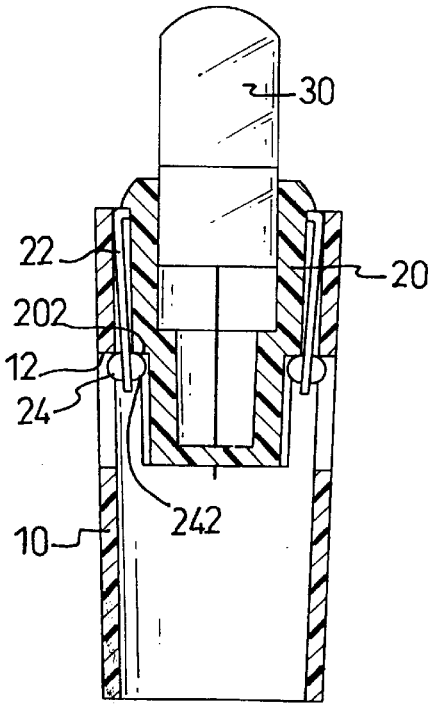
FIG. 5 is a side plan view in partial section of another embodiment of the decorative light with a lock device in accordance with the present invention.

Referring to FIGS. 5 and 6, two locking tabs (22) extend from opposite sides of the base (20). A protrusion is formed on each locking tab (22) and engages with each corresponding retaining structure disposed in the socket (10). This can further improve the holding power between the socket (10) and the base (20). In addition, reference to FIG. 6, the retaining structure is a lip (14) that integrally protrudes toward the center of the socket (10) to engage with the protrusion of each locking tab (22).

With reference to FIG. 1 through 4, a shoulder (202) is integrally formed on the middle portion of the outer periphery of the base (20). A nub (242) is formed on the side of the locking tab (22) facing the shoulder (202) of the base (20), or a lug is formed on the free end of the locking tab (22). When the base (20) is inserted into the socket (10), the nub (24) or the lug (26) corresponding to the retaining structure of the socket (10) can engage with the retaining structure, and the nub (242) or the lug (26) on the other side of the locking tab (22) will engage with the shoulder (202) of the base (20). This can provide a further security to the lock device on the decorative light.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative light comprising:

a socket having at least one retaining feature disposed on an inner periphery of the socket;

a base inserted into the socket;

a locking tab extending from the base and corresponding to each of the at least one retaining feature in the socket;

a protrusion formed on each locking tab to engage with each corresponding one of the at least one retaining feature in the socket; and a bulb mounted on the base wherein each of the at least one retaining features is a lip that integrally protrudes toward a center of the socket.

2. The decorative light of claim 1, wherein the protrusion is a nub integrally formed on a side of each locking tab, wherein the side of the locking tab faces the inner periphery of the socket.

3. The decorative light of claim 1, wherein the protrusion is a lug integrally extending from a free end of the locking tab.

4. The decorative light of claim 1, wherein the base has a middle portion in which a shoulder is formed; and each locking tab has a protrusion formed on a side of the locking tab to engage with the shoulder.

* * * * *